United States Patent [19]

Suzuki et al.

[11] Patent Number: 4,619,109

[45] Date of Patent: Oct. 28, 1986

[54] METHOD AND APPARATUS FOR YARN PIECING IN A FASCIATED YARN SPINNING UNIT

[75] Inventors: Yoshihisa Suzuki, Chiryu; Yoshiharu Yasui, Toyota; Kazuo Seiki, Kariya, all of Japan

[73] Assignee: Kabushiki Kaisha Toyoda Jidoshokki Seisakusho, Kariya, Japan

[21] Appl. No.: 536,886

[22] Filed: Sep. 28, 1983

[30] Foreign Application Priority Data

Oct. 5, 1982 [JP] Japan ..... 57-173845

[51] Int. Cl.[4] ..... D01H 15/00; D01H 15/02; D01H 5/28

[52] U.S. Cl. ..... 57/261; 57/263; 57/328

[58] Field of Search ..... 57/261, 263, 22, 328, 57/350

[56] References Cited

U.S. PATENT DOCUMENTS

| | | | |
|---|---|---|---|
| 3,006,137 | 10/1961 | Long | 57/333 X |
| 3,992,865 | 11/1976 | Tsuchida et al. | 57/328 |
| 4,114,358 | 9/1978 | Tsuchida et al. | 57/328 |
| 4,543,776 | 10/1985 | Seiki et al. | 57/261 |

FOREIGN PATENT DOCUMENTS

| | | | |
|---|---|---|---|
| 35033 | 4/1978 | Japan | 57/261 |

*Primary Examiner*—John Petrakes

*Attorney, Agent, or Firm*—Brooks Haidt Haffner & Delahunty

[57] ABSTRACT

A method of yarn piecing in a fasciated yarn spinning unit is disclosed by which a yarn having a broken end and drawn out from the yarn package is introduced through the false-twisting nozzle by conducting an intermediate portion of the yarn into a slit which is formed on a lateral side of the nozzle and extends to the yarn passage channel in the nozzle. Because the yarn has been previously cut into a predetermined length thereof, the cut end of the yarn is placed in the drafting zone of the drafting mechanism at a position where the cut yarn end overlaps a broken end of the fiber bundle. By restarting the spinning operation, the overlapping ends of the yarn and fiber bundle are drafted properly in the drafting zone and then the fibers in the overlapping ends are intermingled by the false-twisting effect of the rotary stream of jetted air while they are advanced through the false-twisting nozzle.

11 Claims, 10 Drawing Figures

METHOD AND APPARATUS FOR YARN PIECING IN A FASCIATED YARN SPINNING UNIT

BACKGROUND OF THE INVENTION

The present invention relates generally to a method of yarn piecing. More specifically, it relates to a method of yarn piecing in a spinning unit in which a so-called fasciated yarn is produced by the effect of fluid jets.

The process of spinning a yarn which includes core fibers having substantially no twist and peripheral fibers whose ends bind the core fibers is popularly referred to as the fluid jet process, and the resulting yarn as fasciated yarn. This spinning process has attained significant improvements in various respects recently and shown a remarkable increase in its spinning speed accounting for as high as 150 m/min.

In spinning such a fasciated yarn, fibers of sliver or roving are attenuated by a drafting mechanism including pairs of drafting rollers, and then transferred by fiber feeding rollers such as the front pair of the drafting rollers into an aspirator or a false-twisting nozzle, where the drafted fibers are subjected to rotating action by the flow of jetted fluid such as air. The fibers are twisted and then untwisted repeatedly in the false-twisting nozzle while they are advanced continuously through a yarn passage channel formed in the nozzle, thus being transformed into a strand of yarn which includes, as stated in the above, the core fibers having substantially no twist and the peripheral fibers binding said core fibers.

Such a double structure of fasciated yarn poses a problem in a yarn piecing operation performed for the purpose of repairing a break in the yarn. That is, due to the fact that the core fibers of the yarn have substantially no twist, it has been extremely difficult to connect either manually or mechanically the broken end of the yarn and the end of the fiber bundle by using a so-called splicing method in which the ends are joined by intermingling the fibers thereof and twisting them together securely. Accordingly, a knotter has usually been used instead for the purpose of yarn piecing in a fasciated yarn spinning unit. However, a joint formed in the yarn by knotting may cause a defect in the fabrics or knit goods produced in the subsequent weaving and knitting process. It has been a major concern, therefore, how to accomplish yarn piecing by splicing with ease and a high standard of reliability in a fasciated yarn spinning unit operated using a fluid jet process.

A method of yarn piecing by splicing in a fluid jet spinning unit has been disclosed by Japanese Unexamined Patent Publication No. 53-35033 (1978), said method of yarn piecing comprising the steps of introducing a broken end of yarn reversely through a false-twisting nozzle from its outlet, holding the end between a pair of front rollers of the drafting mechanism so as to allow the end to overlap the end of the fiber bundle, and then generating a rotary stream of air in the false-twisting nozzle, whereby the broken ends of the yarn and the fiber bundle are pieced together while they are passed through the false-twisting nozzle.

In this prior art method, however, the end of the yarn unwound from the package and inserted reversely into a yarn passage channel formed through the false-twisting nozzle may be caught by air jetting holes which are formed in the nozzle in a convergent arrangement toward the outlet of the nozzle along the yarn passage channel. Consequently, smooth passing of the yarn end through the channel is not only hampered, but also there is a fear of fiber pieces or impurities contained in the yarn blocking the delicately-drilled air jetting holes thereby to prevent the development of the normal rotary stream of air which is necessary for false-twisting the fibers in the bundle.

Furthermore, in accordance with this prior art method, the end of the yarn brought from its package is grasped at the outlet of the channel, whereupon it is released to be passed reversely through the channel and grasped again at the opposite inlet of the channel. In this way, yarn end grasping which is one of the most risky steps in yarn piecing must be performed twice, which will naturally decrease the rate at which the yarn piecing is accomplished successfully.

SUMMARY OF THE INVENTION

It is an object of the present invention, therefore, to solve the above-mentioned problems of the prior art.

It is another object of the invention to provide a method of, and apparatus for yarn piecing which improves the stability and reliability of the yarn piecing when using a splicing method in a fasciated yarn spinning unit.

In a preferred embodiment of the method according to the present invention, the yarn piecing operation is carried out in a spinning unit which comprises a fiber drafting mechanism having three pairs of top and bottom drafting elements, namely back and front pairs of drafting rollers and a middle pair of aprons, a false-twisting nozzle having a yarn passage channel extending therethrough for receiving a fiber bundle to impart false-twists thereto by the action of a rotary stream of jetted air and also a slit formed in said nozzle along and through said yarn passage channel and opened as required for conducting into the channel a yarn unwound and reversed from a yarn package, and a yarn sensor for detecting a yarn break if any.

In the event of a yarn break, the back rollers and the middle aprons are stopped to tear off the fiber bundle between the aprons by the pulling action of the front rollers which continue to rotate, and the torn-off fiber bundle is passed through the nozzle and discharged for disposal thereof, whereupon the front pair of drafting rollers are stopped and the supply of compressed air into the nozzle is interrupted. The top side drafting elements of the drafting mechanism are moved apart from engagement with their counterparts by an arm which swingably and rotatably carries the top side drafting elements, thereby exposing the fiber bundle passage in the drafting mechanism and simultaneously opening said slit formed in the false-twisting nozzle to permit access to the yarn passage channel from a lateral side of the nozzle.

On the other hand, the broken end of the yarn is picked up and brought adjacently to the drafting area, and it is then cut off to a predetermined length thereof as measured from the package so that the cut leading end is positioned between the aprons in an overlapping relation with the broken end of the fiber bundle when an intermediate part of the yarn is subsequently conducted into the yarn passage channel of the nozzle through the opened slit. Then, bringing the top side drafting elements to their normal operating position in engagement with their counterparts, the slit is closed tightly. In this position, rotation of the drafting rollers and aprons is restarted and simultaneously the supply of compressed air into the false-twisting nozzle is resumed, whereby the overlapped section is passed through the nozzle and the fibers of the overlapped ends are intermingled to be twisted and pieced together under the influence of the false-twisting effect in the nozzle.

In accordance with this method, therefore, the broken end of the yarn to be passed reversely through the false-twisting nozzle need not be conducted from its outlet with the above-mentioned risks. Thus, the method of the invention permits yarn piecing to be carried out in a very stable and reliable manner.

The above and other objects, features and advantages of the present invention will become more readily apparent to those skilled in the art from the following detailed description of a preferred embodiment according to the invention, taken in conjunction with the accompanying drawings, wherein:

DESCRIPTION OF THE PREFERRED EMBODIMENT OF THE INVENTION

Figure 1:
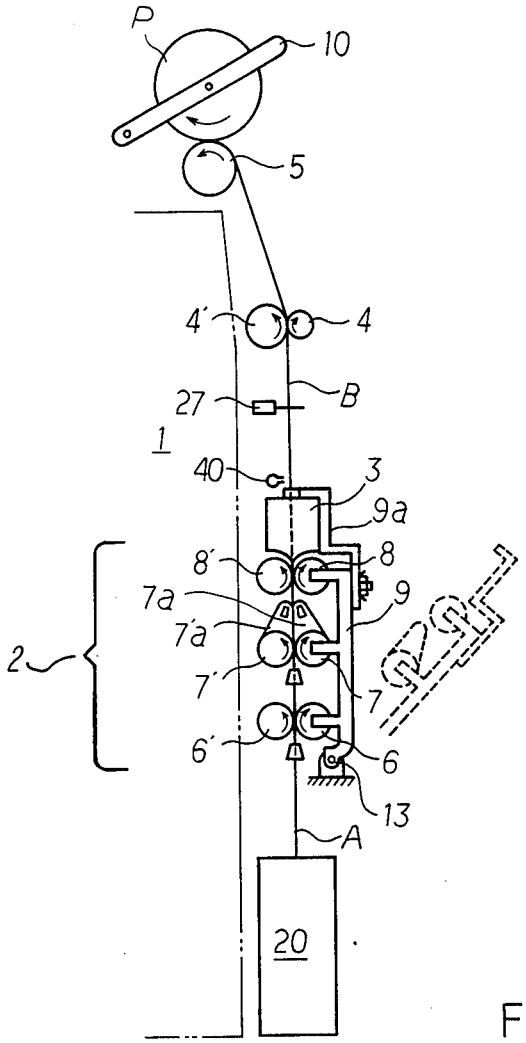
FIG. 1 is a side elevation showing a fasciated yarn spinning unit in which an embodiment of the invention may be practiced.

A fasciated yarn spinning unit, to which an embodiment of the method according to the present invention may be applied, is schematically illustrated in FIG. 1. The unit comprises a drafting mechanism which is generally designated by the reference numeral 2, a false-twisting nozzle 3, a pair of draw-off rollers 4, 4', a take-up roller 5, and an arm 10 for supporting a bobbin for a yarn package P, all of which are arranged on a machine frame 1. The drafting mechanism 2 includes three pairs of top and bottom drafting elements, i.e., back rollers 6, 6', aprons 7*a*, 7'*a* installed on middle rollers 7, 7', and back rollers 8, 8'. In addition, a yarn sensor 27 is provided between the false-twisting nozzle 3 and the draw-off rollers 4, 4'.

A sliver A of fibers which is fed from a sliver can 20 placed on the floor is transferred to the drafting mechanism 2, where the sliver A is subjected to the drafting action thereby and consequently attenuated into a ribbon-shaped fiber bundle with a required thickness. The fiber bundle thus drafted is then delivered from the front rollers 8, 8' into a yarn passage channel 11 (FIGS. 3, 9 and 10) provided through the false-twisting nozzle 3, and placed under a twisting effect caused by a vortex or a rotary stream of air which is developed in the yarn passage channel 11 by air streams ejected from a plurality of air jetting holes 12, thus being transformed eventually to a strand of fasciated yarn as described earlier. The yarn B thus produced is drawn out continuously from the outlet of the false-twisting nozzle 3 by the draw-off rollers 4, 4' and then wound on the bobbin via the take-up roller 5 to form a yarn package P.

In carrying out the method of the invention, the top side drafting elements 6, 7 and 8 of the pairs in the drafting mechanism 2 are advantageously carried by a supporting arm 9 which is swingable on a shaft 13 between the operative or closed position during normal spinning operation where the top side elements, namely the back roller 6, middle apron 7*a* and front roller 8, are pressed in contact with their corresponding bottom side elements including the back roller 6', middle apron 7'*a* and front roller 8', respectively (which is shown by solid lines in FIG. 1) and the inoperative or open position during the yarn piecing operation where the aforementioned top side elements are moved apart from their bottom side counterparts (which is shown by dotted lines in the same figure). In the inoperative swung-out position of the arm 9, the passage of the fiber bundle in the drafting mechanism 2 is exposed.

The bottom rollers 6', 7' and 8' are connected respectively to their independent driving shafts through any suitable power transmitting means such as electromagnetically-operated clutches (not shown) to allow each of the bottom rollers to be engaged or disengaged with or from its driving shaft independently of the other bottom rollers.

Figure 2:
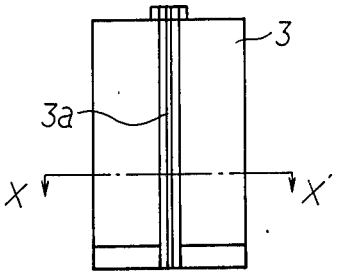
FIG. 2 is a plan view showing a false-twisting nozzle which has a slit formed therein through which an intermediate part of the yarn may be introduced into a yarn passage channel in the nozzle.
Figure 3:
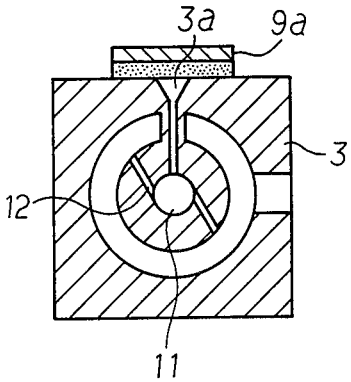
FIG. 3 is a transverse sectional view taken on the line X—X of FIG. 2.
Figure 4:
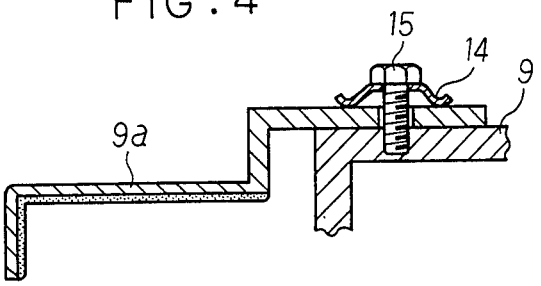
FIG. 4 is a side elevation showing a lid means for the slit in the false-twisting nozzle.

Reference is now made to FIGS. 2 and 3 showing the false-twisting nozzle 3 in plan and transverse sectional views, respectively. The false-twisting nozzle 3 has a slit 3*a* therein extending along the entire axial length of the yarn passage channel 11 and also transversely from a lateral side of the nozzle to the channel for permitting easy access of the yarn B therethrough to the yarn passage channel. As seen clearly in FIG. 3, the slit 3*a* is widened at its inlet portion for positive receiving of the yarn B. The slit 3*a* is normally shut off during the spinning operation by a closing means such as lid 9*a* and is which is attached to the roller supporting arm 9 therefore movable integrally therewith, but it may be opened by swinging away the arm 9 on its shaft 13 to the aforesaid inoperative position. As shown in FIG. 4, the lid 9*a* is fastened resiliently to the arm 9 by means of a bolt 15 via a spring 14 for closing the slit 3*a* airtightly regardless of a slight movement, if any, of the arm 9 in its operative position.

The yarn piecing operation is preferably performed by an automatic yarn piecing device of a known structure which travels along the spinning units of the machine and stops at a spinning unit calling for yarn piecing service thereby. As partially shown in FIG. 6, the yarn piecing device to be used in practicing the method of the invention includes an unwinding roller 24 which rotates the package P in reverse direction when the package P is released from its contact with the take-up roller 5; a suction tube 26 for locating and picking up a broken end of the yarn B from the package P and then transferring it adjacently to the drafting area through a slit (not shown) which is formed in the suction tube 26 on the inside of its curved configuration along its longitudinal direction; a yarn catcher 29 having a pair of rollers 30, 31 for catching or holding the yarn B at a point adjacent to the base end of the suction tube 26; a cutter 28 for cutting off the yarn B at a point between the yarn catcher 29 and the base end of the suction tube 26 for determining the length of the yarn B as measured from the package P; and a yarn conducting means 34 which is operated in conjunction with the yarn catcher 29 for introducing an intermediate portion of the yarn B into the yarn passage channel 11 in the false-twisting nozzle 3 through its slit 3*a*.

A preferred embodiment of the method of yarn piecing in the above-described spinning unit will now be explained in accordance with the steps thereof with reference to FIGS. 5 to 8.

Figure 5:
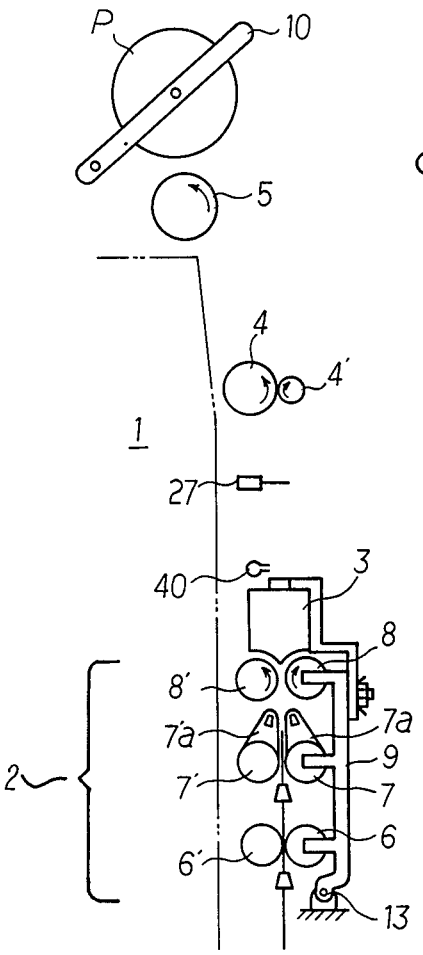
FIGS. 5 to 8 are side views illustrating the steps of yarn piecing in the embodiment of the invention, respectively.

A yarn break, if any, is detected by the yarn sensor 27 which is positioned between the false-twisting nozzle 3 and the draw-off rollers 4, 4'. The clutches for the back bottom roller 6' and middle bottom roller 7' are caused to disengage thereby to stop the rotation of the back rollers 6, 6' and the middle rollers 7, 7', and therefore the aprons 7*a*, 7'*a* which are driven by the middle rollers, while the front rollers 8, 8' continue to run. Accordingly, feeding of the sliver A is stopped and the fiber bundle in the drafting area is torn off at a point where it is held relatively loosely between the aprons 7*a*, 7'*a*, due to the pulling action by the front rollers 8, 8' which continue to rotate. The torn-off fiber bundle released from the nip by the aprons is passed through the false-twisting nozzle 3 and then drawn by suction into a discharging tube 40 which is located in the vicinity of the outlet of the nozzle. On the other hand, the broken end of the remaining fiber bundle is held at an intermediate position between the aprons 7*a*, 7'*a*. Subsequently, the front rollers 8, 8' are stopped and the supply of compressed air to the air jetting holes 12 in the false-twisting nozzle 3 is shut off. The broken end of the yarn B is wound up on the package P, and the package is released from its driving contact with the take-up roller 5. (FIG. 5)

Figure 6:
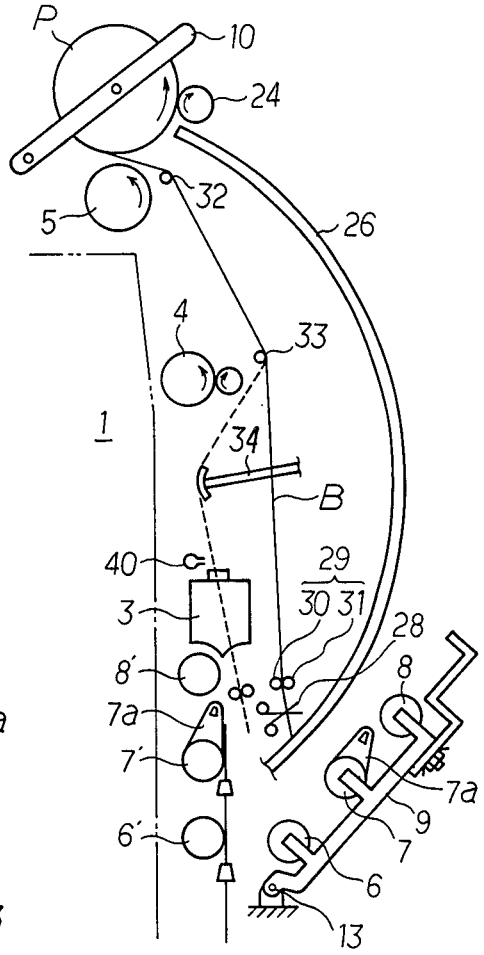

According to a yarn-break signal transmitted by the yarn sensor 27, the travelling yarn piecing device is brought to the front of the relevant spinning unit calling for a yarn piecing service thereby. The device commences its yarn piecing operation firstly by swinging the supporting arm 9 on its shaft 13 by any suitable means such as air cylinder (not shown) provided on the yarn piecing device, for separating the top side drafting elements 6, 7*a*, 8 from the respective bottom side counterparts 6', 7'*a*, 8' and simultaneously opening the slit 3*a*. Substantially simultaneously, the unwinding roller 24 is brought into contact with the package P and rotates the same in its reverse or unwinding direction. The broken end of the yarn B on the package P is located and picked up by the suction tube 26 one end of which is positioned adjacently to the package surface. The yarn B is drawn back through and along the curved suction tube 26 and then transferred through a longitudinal slit (not shown) formed along the inside wall of the curved tube to a position which is represented by the solid line in FIG. 6. Simultaneously, the unwinding roller 24 is turned off to stop unwinding of the yarn B. As is seen in FIG. 6, the yarn B in this position is prevented from being brought into contact with the take-up roller 5 and the draw-off rollers 4, 4' by means of yarn guides 32, 33 provided on the yarn piecing device. The yarn catcher 29 having a pair of rollers 30, 31 movable toward and away from each other is actuated to hold the yarn B therebetween, whereupon the cutter 28 is operated to cut off the yarn for removing its excess free end portion thereby to have a predetermined length of the yarn B corresponding to the distance of the yarn passage extending from the yarn package P through the false-twisting nozzle 3 to a point in the drafting mechanism 2 during the state shown in FIG. 7 which is to be described in later part hereof. Simultaneously with this movement, the yarn conducting means 34 disposed between the nozzle 3 and the draw-off rollers 4, 4' is actuated to push the yarn B leftwardly as seen in FIG. 6. Thus, an intermediate portion of the yarn is introduced into the false-twisting nozzle 3 through the slit 3*a* by the simultaneous movement of the yarn catcher 29 and the yarn conducting means 34, which state is shown by the dotted line in FIG. 6. The yarn catcher 29 then releases the yarn end and is retracted to its original position. The yarn end is therefore placed in a freely depending state in the area of the middle apron 7'*a*.

Figure 7:
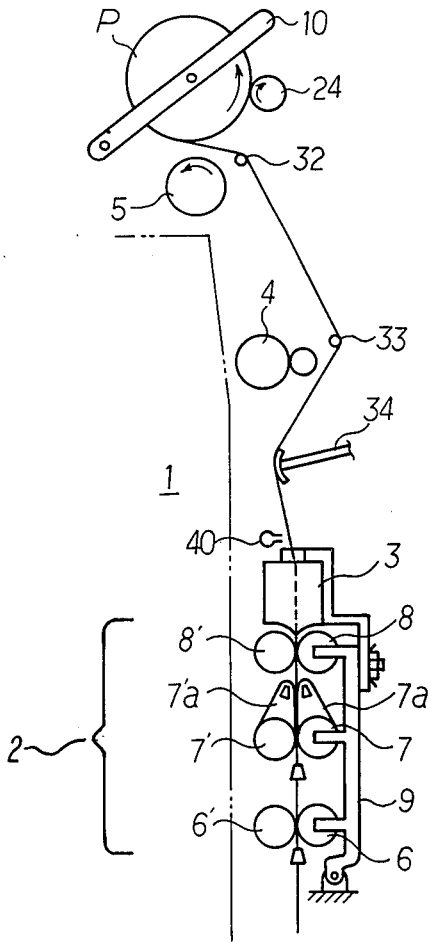

After the yarn end is released from the catcher 29, the supporting arm 9 is moved back to its normal pressing position, in which the yarn end overlaps the torn-off end of the fiber bundle over a length and the both ends are held between the middle aprons 7*a*, 7'*a* as shown in FIG. 7. Therefore, the above-said predetermined length mentioned in connection with cutting off the yarn B by the cutter 28 is so established that the cut end of the yarn may at least overlap with the end of the fiber bundle between the middle aprons 7*a*, 7'*a*.

Figure 8:
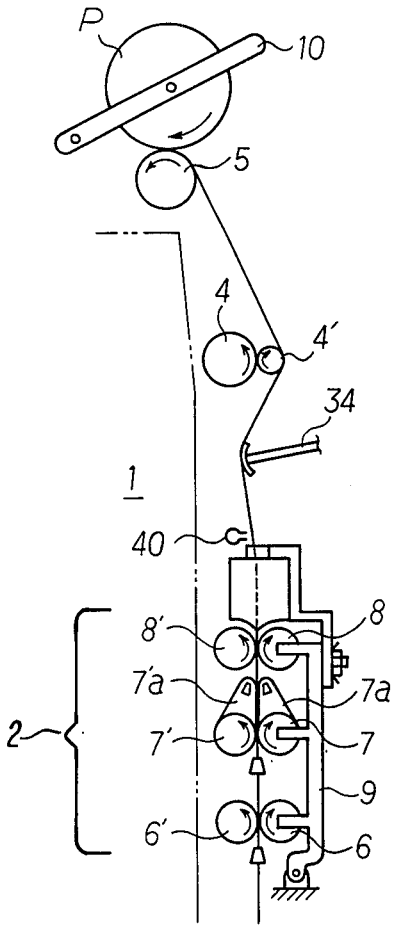

As the supporting arm 9 is swung back to the operative position to nip the yarn B and the fiber bundle between the respective pairs of the drafting elements, a control signal is provided which causes the clutches for the bottom side rollers 6', 7' and 8' to be engaged thereby to restart the drafting operation of the mechanism 2, and also allows compressed air into the false-twisting nozzle 3. Simultaneously, the unwinding roller 24 is moved apart from the package P and the latter is brought back into contact with the take-up roller 5, and the yarn guides 32, 33 are retracted to their original inoperative positions. Thus the spinning unit resumes its normal spinning operation. Accordingly, the overlapped ends of the yarn B and the fiber bundle undergo drafting action effected between the middle pair of aprons 7*a*, 7'*a* and the front pair of rollers 8, 8' to be equalized in thickness, and then are introduced into the false-twisting nozzle 3. The fibers in the overlapped portion are subjected to a false-twisting effect by the rotary stream of air and intermingled thereby as they are advanced within the nozzle 3. In this way, the ends of the yarn and fiber bundle are joined or pieced up together to form a part of a continuous strand of false-twisted yarn by the time when they come out from the false-twisting nozzle 3. (FIG. 8)

As the spun yarn gains its normal level of tension, it is automatically transferred to and held between the draw-off rollers 4, 4' by using a known yarn hooking means such as a notch (not shown) formed on an edge portion of the top-side draw-off roller 4. Then, the yarn conducting means 34 is returned to its original position. (FIG. 1)

As is now apparent from the foregoing, the method of yarn piecing according to the present invention is advantageous over the prior art in that a yarn unwound from its package may be introduced positively into the yarn passage channel of the false-twising nozzle from a longitudinal slit with extreme ease, thus eliminating the need for inserting the broken end of the yarn from the nozzle outlet. Consequently, the risky steps of holding the yarn end at the outlet and inlet of the nozzle before and after the yarn end is passed through the nozzle may be dispensed with, with the result that the rate of successful yarn piecing can be improved greatly. Furthermore, because the ends of the yarn and fiber bundle are placed in overlapping relation within the area of the middle aprons of the fiber drafting mechanism and therefore may be drafted adequately, the thickness variation of the yarn containing a joint formed due to piecing may be reduced.

Figure 9:
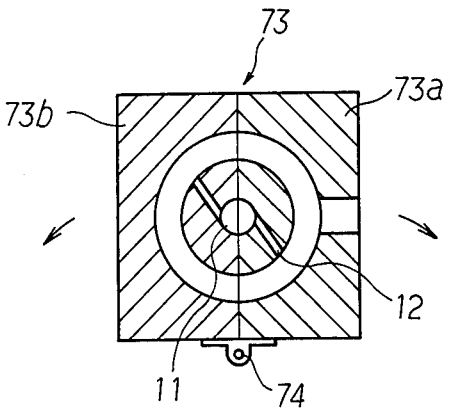
FIGS. 9 and 10 are similar to FIG. 3, but showing other structures of the false-twisting nozzle which may be used in carrying out the method of the invention.
Figure 10:
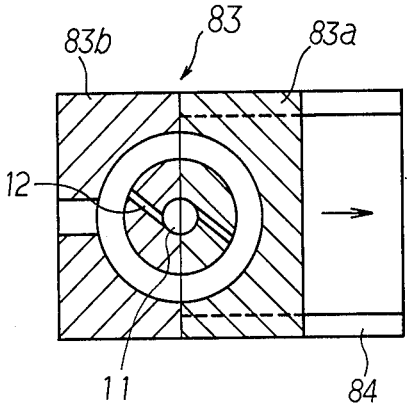

FIGS. 9 and 10 show other possible forms of the false-twisting nozzle, respectively, which may be employed in embodying the method of the invention. The false-twisting nozzle 73 of FIG. 9 differs from the counterpart 3 having a slit 3*a* shown in FIG. 3 in that the former is divided along a plane containing the axis of the yarn passage channel 11 into two separable parts 73*a*, 73*b* which are connected together by any suitable means such as hinge 74. In introducing a yarn unwound from a package, the halves 73*a*, 73*b* are separated from each other by pivoting either or both of the halves on the hinge 74 so that a gap permitting access to the channel 11 may be provided.

In FIG. 10, the nozzle 83 is also divided into two parts 83*a*, 83*b* as in the nozzle 73 of FIG. 9, but one part 83*a* is made displaceable toward and away from the other part 83*b* along a slide guide such as is provided by grooves 84. In introducing a yarn, the part 83*a* is slid rightwards as viewed in FIG. 10 so as to form a gap which performs the same function as the slit 3*a* of the nozzle 3.

Though in the above-described embodiment the ends of the yarn and fiber bundle are overlapped in the area of the middle aprons, they may be positioned in other areas such as between the front drafting rollers.

While the invention has been described and illustrated with reference to specific embodiments thereof, it is to be understood that various changes in the details may be made without departing from the spirit and scope of the invention.

What is claimed is:

1. A method of yarn piecing in a spinning unit comprising a fiber drafting mechanism having plural pairs of top and bottom drafting elements including at least back and front pairs for drafting a fibrous material into an attenuated fiber bundle, a false-twisting nozzle having a yarn passage channel extended therethrough in which the attenuated fiber bundle is false-twisted by the action of a fluid jet into a strand of yarn to be wound up in a package, and a yarn sensor for detecting a break in the yarn, said method comprising the steps of breaking off the fiber bundle in the drafting zone of the drafting mechanism leaving a broken end thereof within said drafting zone, moving said top and bottom drafting elements apart and substantially concurrently opening an axial gap extending to and along said yarn passage channel of said false-twisting nozzle to open said drafting mechanism and said channel continuously along their respective lengths, picking and drawing out a broken yarn end from the package, cutting off the yarn drawn out from the package to a predetermined length thereof as measured from said package, introducing an intermediate portion of the yarn in lateral direction into said opened fiber drafting mechanism and yarn passage channel, said predetermined length being established such that a cut end of the yarn may at least overlap said broken end of the fiber bundle within said drafting zone, moving said top and bottom drafting elements together and substantially concurrently closing said gap to close said yarn passage channel, advancing the overlapped ends within the drafting zone and then through said yarn passage channel in the false-twisting nozzle, and false-twisting said overlapped ends to thereby piece the same together within said channel.

2. A method of yarn piecing according to claim 1, wherein said breaking off of the fiber bundle is performed by stopping the rotation of at least the back pair of said drafting elements while allowing the front pair to continue to rotate.

3. A method of yarn piecing according to claim 1, wherein said plural pairs of top and bottom drafting elements include a middle pair of aprons and said breaking off the fiber bundle is performed by stopping rotation of said back and middle pairs while allowing the front pair to continue to rotate.

4. A method of yarn piecing according to claim 3, wherein said overlapping of said cut and broken ends takes place between the middle pair of aprons.

5. In a yarn spinning unit of the false-twisting type having a fiber drafting mechanism including at least respective back and front aligned pairs of rotatable drafting elements for receiving and drafting sliver therebetween, the drafting elements in each said pair normally engaging the other drafting element of the pair, and a false-twisting nozzle aligned with said aligned pairs of drafting elements and having a yarn passage channel extending therethrough in said direction of alignment for receiving and spinning said sliver, the improvement comprising yarn piecing apparatus for piecing a broken yarn being spun in said spinning unit and comprising means for moving one of said drafting elements in each said pair thereof out of its said engagement with the other drafting element of the pair whereby all of said pairs of drafting elements are concurrently opened laterally for receiving said broken yarn when a length thereof is moved in lateral direction between all of said opened pairs, means for opening said yarn passage channel laterally along its length for concurrently receiving said length of the yarn in lateral direction within and along the length of said channel when said yarn length is moved laterally between said opened pairs of drafting elements, and means for closing said yarn passage channel and moving said opened pairs of drafting elements to their said normally engaging positions.

6. The improvement according to claim 5, wherein said means for opening and closing said false-twisting nozzle comprises a plainly defined lateral yarn-receiving slit therein extending from its exterior to and along the length of said yarn passage channel, and means for opening and closing said slit along its length.

7. The improvement according to claim 6, wherein said means for opening and closing said false-twisting nozzle slit comprises movable support arm means mounting said one of said drafting elements in each said pair thereof for concurrently moving the same into and out of their said engagement with the other drafting element of the pair, said support arm further carrying a slit lid for opening and closing said false-twisting nozzle slit concurrently with said opening and closing of said pairs of drafting elements.

8. The improvement according to claim 7, wherein said slit lid is mounted for flexible movement on and with respect to said support arm.

9. The improvement according to claim 5, wherein said false-twisting nozzle comprises first and second halves thereof, and means for moving said first and second halves into and out of engagement with each other, said yarn passage channel being formed extending along the interface therebetween when said first and second halves are in their said engagement with each other.

10. The improvement according to claim 9, wherein said means for moving said first and second halves of said false-twisting nozzle comprises hinge means attaching said halves together whereby said halves are pivotable into and out of their said engagement.

11. The improvement according to claim 9, wherein said means for moving said first and second halves of said false-twisting nozzle comprises slide glide means mounting said halves whereby one of said halves is slidable with respect to the other into and out of their said engagement.

* * * * *